US007528786B1

(12) United States Patent
Koslover

(10) Patent No.: US 7,528,786 B1
(45) Date of Patent: May 5, 2009

(54) FLAT-APERTURE WAVEGUIDE SIDEWALL-EMITTING ANTENNA

(76) Inventor: Robert Koslover, 2726 Rockbridge Rd., Tyler, TX (US) 75701

( * ) Notice: Subject to any disclaimer, the term of this patent is extended or adjusted under 35 U.S.C. 154(b) by 73 days.

(21) Appl. No.: 11/982,882

(22) Filed: Nov. 6, 2007

Related U.S. Application Data

(60) Provisional application No. 60/857,529, filed on Nov. 7, 2006.

(51) Int. Cl.
*H01Q 13/00* (2006.01)

(52) U.S. Cl. ..... 343/772; 333/237

(58) Field of Classification Search ..... 343/772, 343/778, 786, 771; 333/24.2, 157, 237, 239
See application file for complete search history.

(56) References Cited

U.S. PATENT DOCUMENTS 3,646,486 A * 2/1972 Wen ..... 333/24.2
4,518,967 A * 5/1985 Westerman ..... 343/771
5,416,492 A * 5/1995 Takahashi et al. ..... 343/771
6,995,724 B2 * 2/2006 Teshirogi et al. ..... 343/771

* cited by examiner

*Primary Examiner*—Hoang V Nguyen
(74) *Attorney, Agent, or Firm*—Stetina Brunda Garred & Brucker

(57) ABSTRACT

A flat-aperture waveguide sidewall-emitting antenna in a compact low-profile configuration and with the capability of radiating a beam of extremely high-power microwave (HPM) pulses in a directional manner is provided. High-power microwave antennas are essential technologies to microwave-based directed energy weapons (DEW). The flat-aperture waveguide sidewall-emitting antenna is especially well-suited to high-power microwave operation because of its relatively large aperture, which distributes the output power evenly over a large area, thus reducing the risk of microwave-induced air-breakdown or surface-breakdown that would other wise impede proper operation and degrade output beam formation.

6 Claims, 9 Drawing Sheets

INDUCTIVE SHEET ANTENNA

FLAT-APERTURE WAVEGUIDE SIDEWALL-EMITTING ANTENNA

CROSS-REFERENCE TO RELATED APPLICATIONS

The present application claims priority to Provisional Patent Application Ser. No. 60/857,529, filed on Nov. 7, 2006, entitled FLAT-APERTURE WAVEGUIDE SIDEWALL-EMITTING ANTENNA.

STATEMENT RE: FEDERALLY SPONSORED RESEARCH/DEVELOPMENT

This invention was made with Government support under Contract No. FA9451-04-C-0155 awarded by the U.S. Air Force. The Government has certain rights in the invention.

BACKGROUND

The present invention relates in general to an antenna, and more particularly, to a flat-aperture waveguide sidewall-emitting antenna (FAWSEA) which provides a compact, low-profile configuration suitable for airborne or other fieldable platforms.

The FAWSEA is properly categorized as a leaky-waveguide antenna of the fast-wave type. The physical principles behind the operation of the FAWSEA's waveguide and leaky-wire-grill are essentially the same as those reported decades ago by R. C. Honey as shown in FIG. 1. The design of Honey does not appear to be suitable for high-peak power microwave operation nor could it be easily joined to a realistically-configured high-power microwave source in any obvious manner.

BRIEF SUMMARY

A flat-aperture waveguide sidewall-emitting antenna in a compact low-profile configuration and with the capability of radiating a beam of extremely high-power microwave (HPM) pulses in a directional manner is provided. High-power microwave antennas are essential technologies to microwave-based directed energy weapons (DEW). The flat-aperture waveguide sidewall-emitting antenna is especially well-suited to high-power microwave operation because of its relatively large aperture, which distributes the output power evenly over a large area, thus reducing the risk of microwave-induced air-breakdown or surface-breakdown that would other wise impede proper operation and degrade output beam formation.

The conveyance of the input microwave power from one or more standard-size rectangular waveguides to a large aperture, in a low-profile package, is not practical with more conventional means such as a pyramidal horn. This is because serious phase-front distortion (phase error) and wave-reflection will occur if such a horn is made too short. In contrast to most alternative approaches for delivering such large apertures, the flat-aperture waveguide sidewall-emitting antenna possesses an unusually shallow depth especially advantageous for integration into fieldable military platforms. Such a low-profile (i.e., shallow depth) antenna is made possible by the novel employment of a specially-profiled, leaky-wave wire grill as the aperture comprising the sidewall of the waveguide, with the grill-wires oriented parallel to the electric field of the waveguide mode being conveyed.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Figure 1:
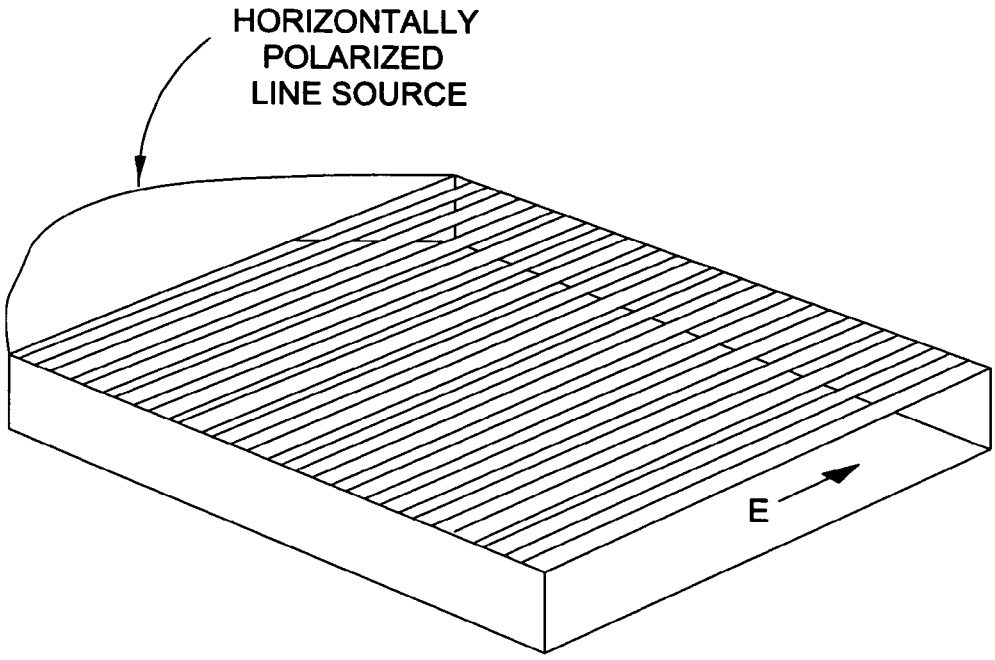
FIG. 1 shows a conventional low-profile leaky waveguide antenna.
Figure 2:
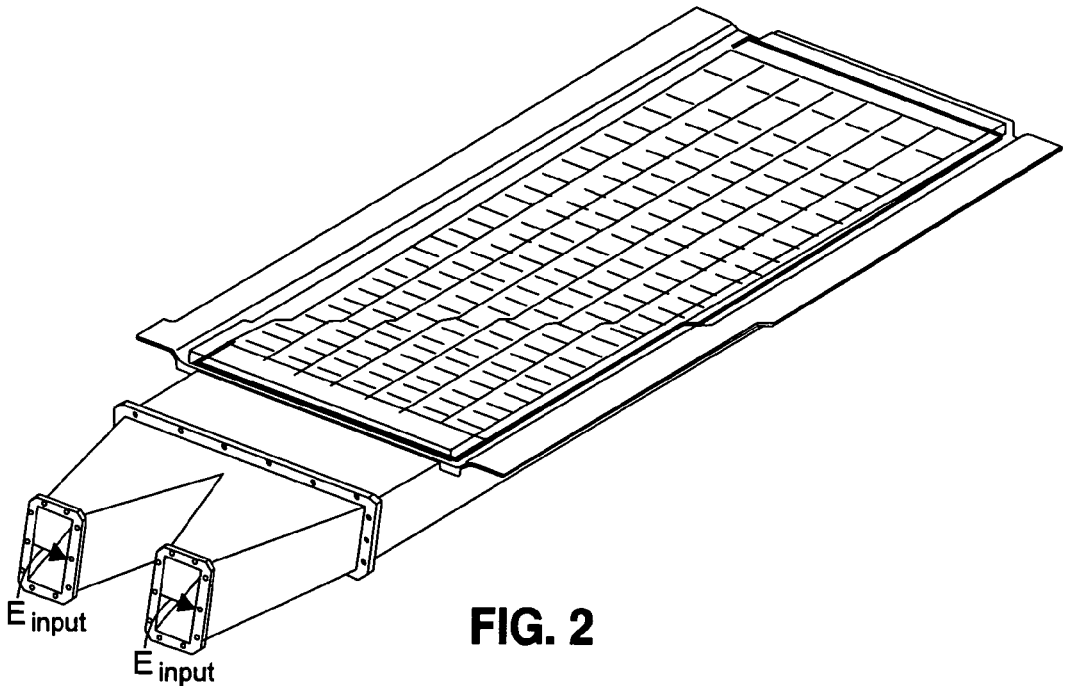
FIG. 2 is a perspective view of an assembly of flat-aperture waveguide sidewall-emitting antenna with orientation of input waveguide mode.
Figure 3:
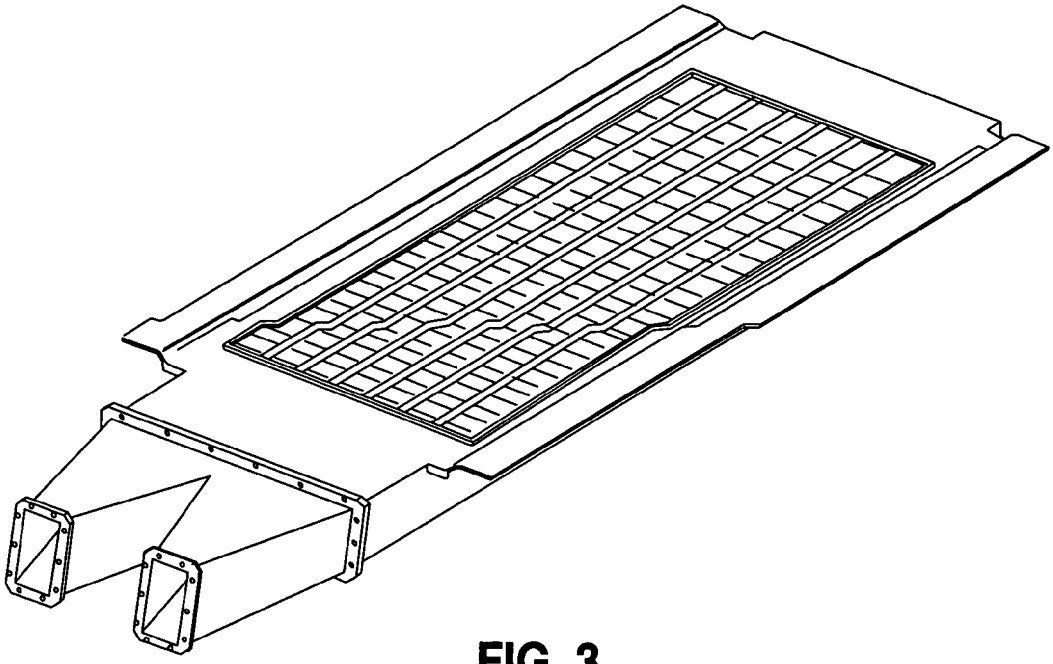
FIG. 3 shows the flat-aperture waveguide sidewall-emitting antenna of which an aperture window is removed.
Figure 4:
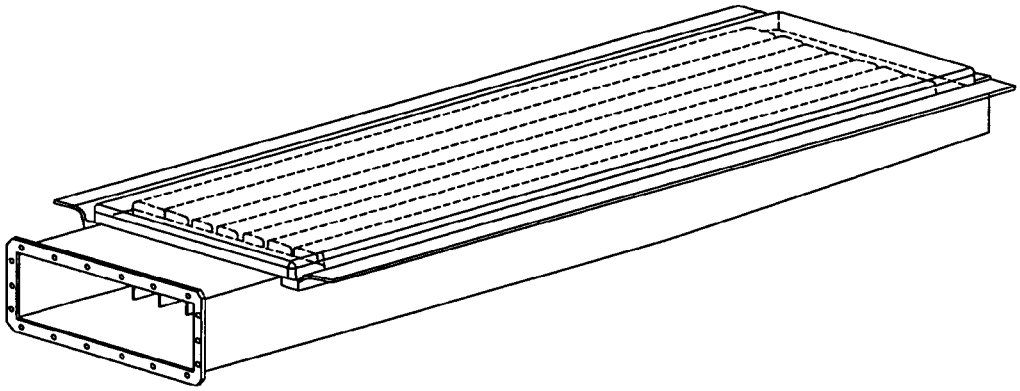
FIG. 4 shows the flat-aperture waveguide sidewall-emitting antenna that does not include the flared input waveguides.
Figure 5:
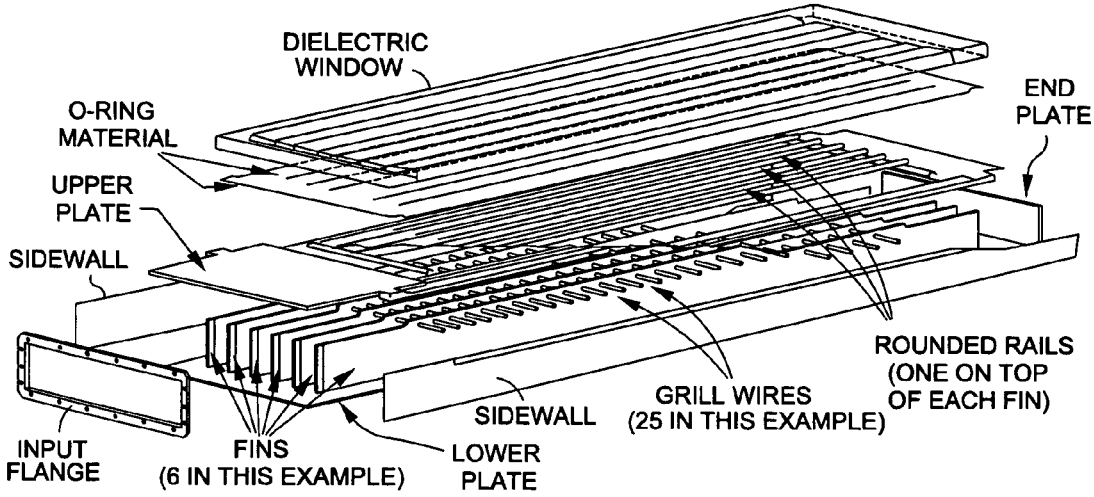
FIG. 5 is an exploded view of a flat-aperture waveguide sidewall-emitting antenna that does not include flared input waveguides or outer lips.

Referring now to the drawings, FIGS. 2 and 3 provide exterior views of an exemplary flat-aperture waveguide sidewall-emitting antenna as provided. Normally, the interior of the antenna is evacuated to high-vacuum during high-power microwave operation. A dielectric window is mounted to the antenna covering the aperture and an o-ring is applied to provide a vacuum-to-air seal. FIGS. 4 and 5 show additional views of the flat-aperture waveguide sidewall-emitting antenna with certain features identified.

As mentioned above, the flat-aperture waveguide sidewall-emitting antenna is properly categorized as a leaky-waveguide antenna of the fast-wave type. The flat-aperture waveguide sidewall-emitting antenna overcomes the limitations of the antenna proposed by Honey through the employment of several new features, which together represent a significant advance. The new features includes: a truly high-power microwave capable input feed configuration, utilizing one or more tapered waveguide sections flared primarily in their E-planes, and which are only practical to employ due to the incorporation of multiple fins running the length of the antenna, necessary to suppress growth of undesirable modes that would otherwise corrupt the desired field configuration; application of carefully-shaped and rounded polished rails on the fins and on the aperture edges, to suppress vacuum breakdown inside the antenna; employment of carefully-optimized shapes to the window edges and exterior metallic surfaces in the vicinity of where the window joins the metallic body of the antenna, so as to suppress fields there that would otherwise cause air breakdown and/or surface breakdown; and detailed optimization of the individual aperture grill-wire diameters, separations, and placements, specifically to enable generation of nearly-uniform magnitude and nearly-linear phase along the exterior of the aperture, while said wires are in direct proximity to the high-power capable dielectric window.

The FAWSEA as designed would have been exceedingly difficult or even impossible to design in past decades, since it leverages fundamentally the results of detailed 2D and 3D full-wave numerical electromagnetic models, iteratively-executed to determine optimal configurations. Execution of such modeling computer programs requires high-speed, high memory-capacity computers that were not available previously.

Figure 6:
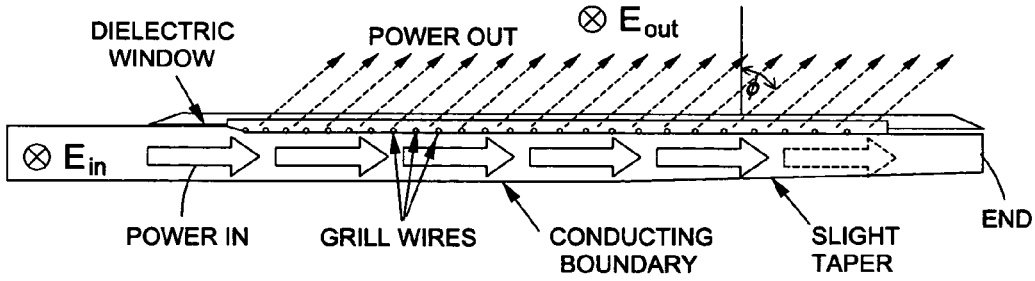
FIG. 6 shows the leaky-wave operation principle of the flat-aperture waveguide sidewall-emitting antenna.
Figure 7A:
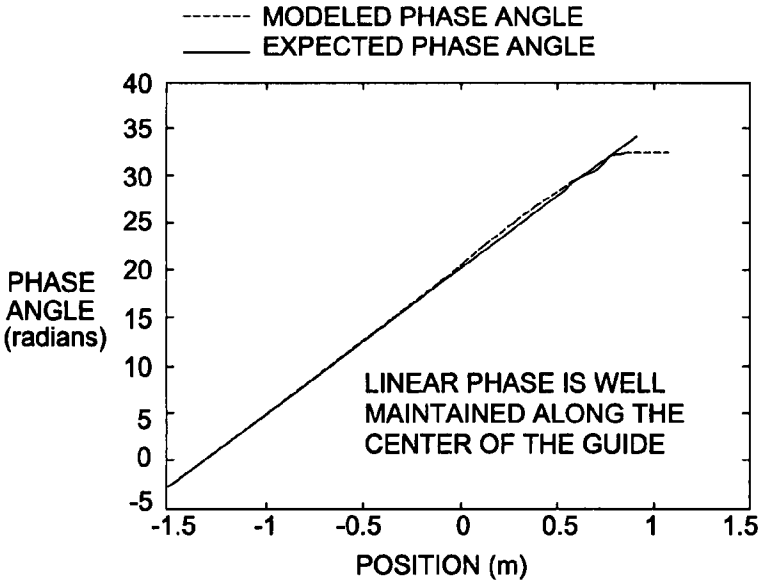
FIGS. 7A-7C show the results of a two-dimensional finite element model of the flat-aperture waveguide sidewall-emitting antenna.
Figure 7B:
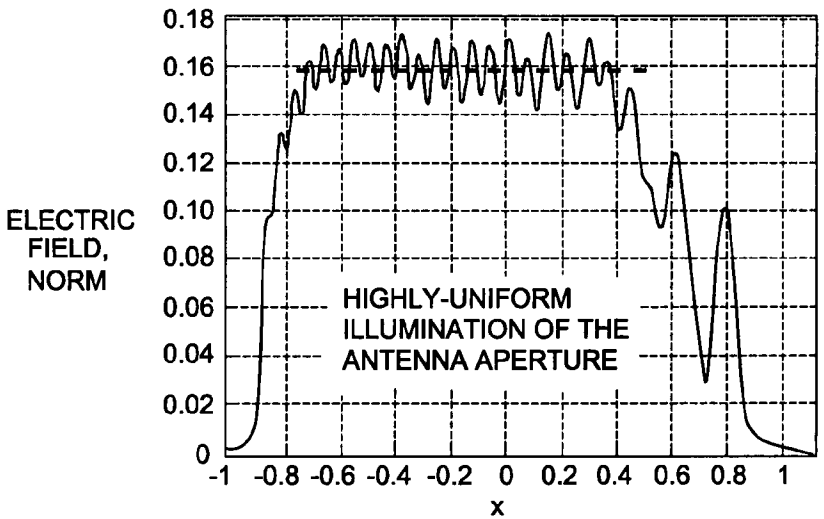
Figure 7C:
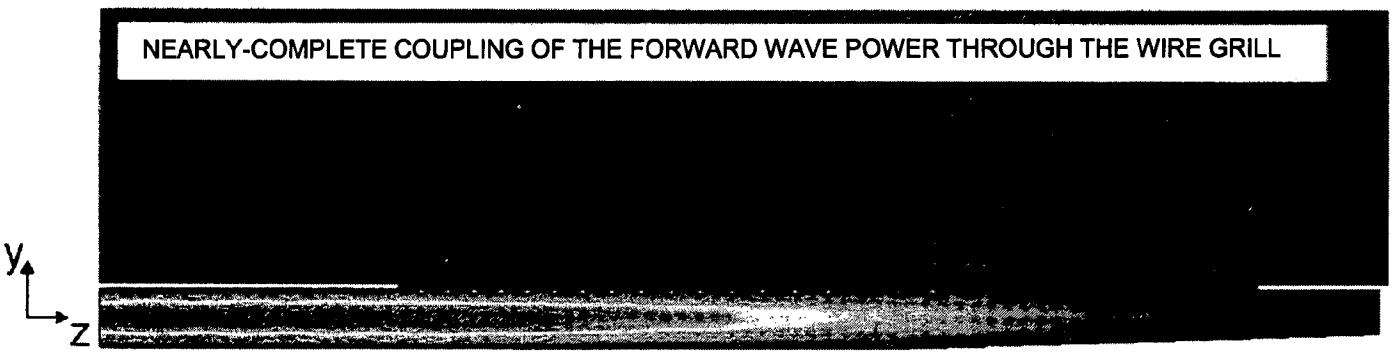

The leaky-wave operating principle is presented in FIG. 6. The wave is emitted at an angle f relative to the aperture-normal, given by $\cos \phi = f_c/f$, where $f_c$ is the cutoff frequency of the wave guiding structure. Employing an optimized combination of increasing wire-to-wire separations and decreasing wire diameters as the wave propagates from left to right is necessary in order to hold the radiated power per length constant along the aperture. However, this same thinning-out of the wire-grill would also lead to a decrease in $f_c$ along the length of the antenna, and thus an undesirable departure from linear phase along the aperture, if not for the slight taper we also introduce in the wall opposite to the wire grill, which is also noted in FIG. 6. This slight taper compensates for the phase error caused by the thinning of the wire-grill, keeping the effective value of $f_c$ fixed. Thus, the power output/length can be held constant while the phase increases at a constant rate along the aperture. These are ideal conditions for both high power operation and for the generation of a well-formed, high-gain, output beam, as demonstrated in results from numerical models, such as shown in FIGS. 7A-7C.

Figure 8:
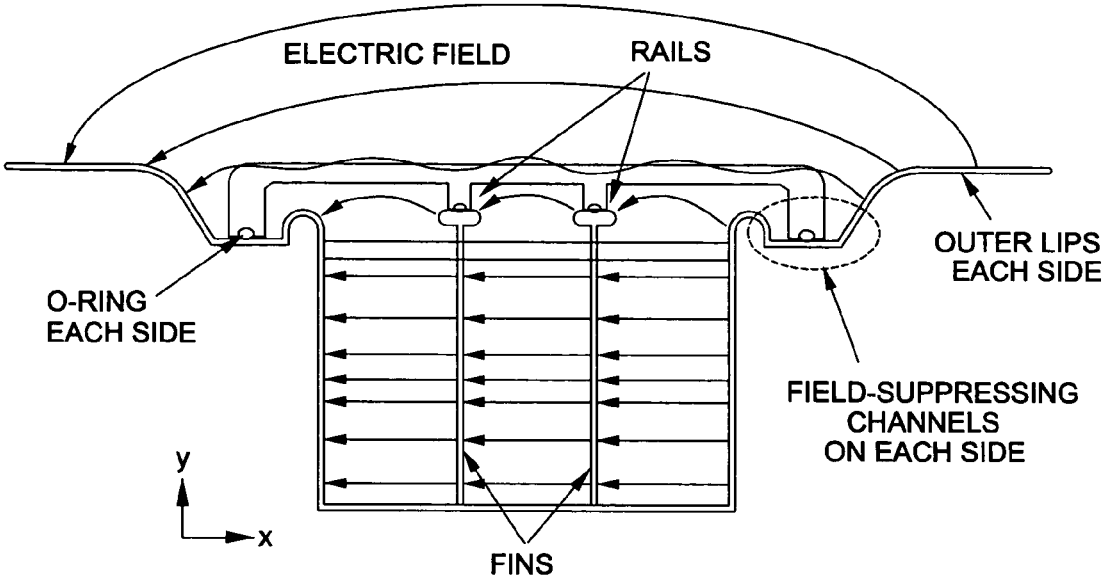
FIG. 8 illustrates a cross-sectional view of a narrow flat-aperture waveguide sidewall-emitting antenna.
Figure 9A:
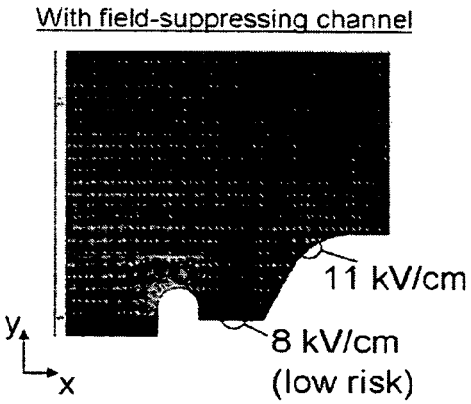
FIG. 9A shows a three-dimensional numerical model of fields in the vicinity of the window edges of an L-band flat-aperture waveguide sidewall-emitting antenna intended for operation at P>1GW peak power.
Figure 9B:
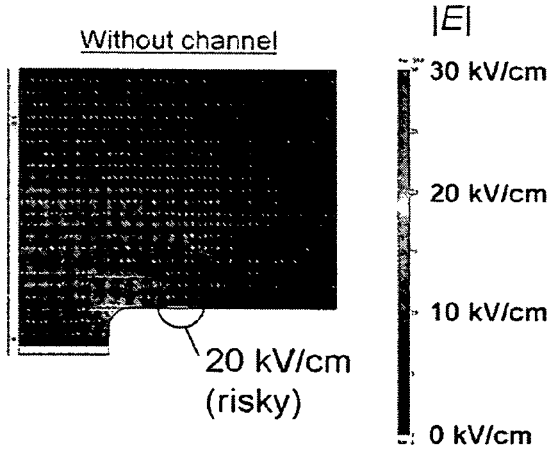
FIG. 9B shows an earlier design that does not include a field-suppressing channel, which leads to strong fields where the window, metal and conductor meet.

FIG. 8 shows a cross-sectional view of a relatively narrow FAWSEA. This includes key features such as the rails at the tops of the fins, how the dielectric aperture window rests upon them and upon the carefully shaped sides of the aperture in channels that suppress the electric field at locations that would otherwise be at high risk for breakdown if used under HPM operating conditions. Overall, this configuration minimizes electric field stresses at the key interfaces, which would otherwise cause exterior and/or interior arcs under the operating conditions for which this antenna is intended. FIG. 9A shows a numerical model of the fields in the field-suppressing region, and FIG. 9B shows a numerical model of the fields of a model of a simpler configuration without employing a channel. The field-suppressing channels are best illustrated in the cutaway view provided by FIGS. 10 and 10A.

Figure 10:
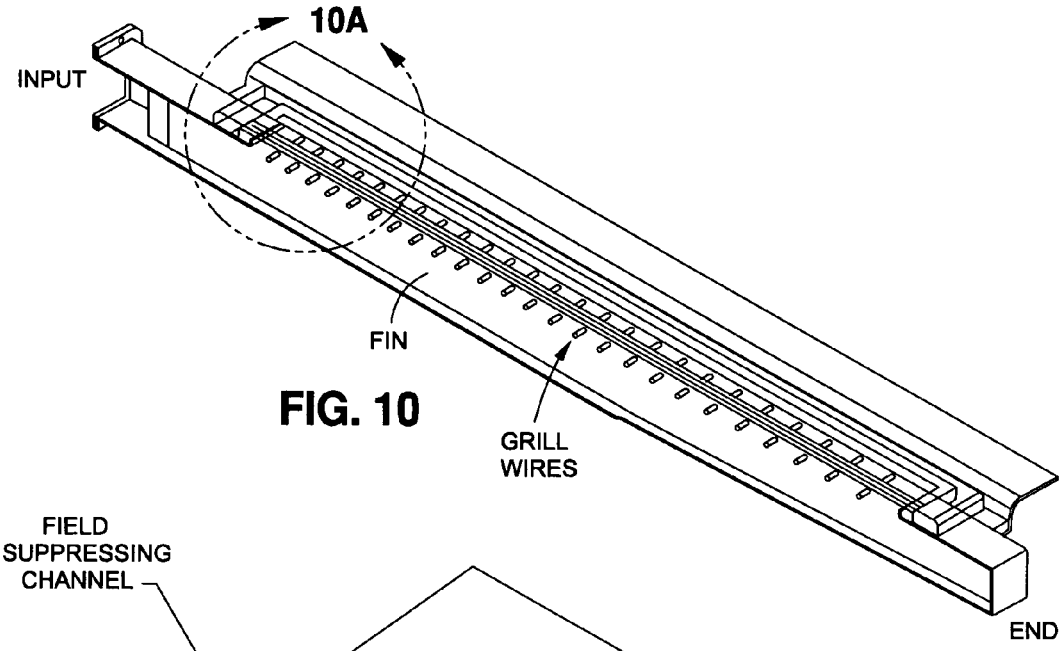
FIG. 10 shows the edges and field-suppressing channels provided by the flat-aperture waveguide sidewall-emitting antenna.
Figure 10A:
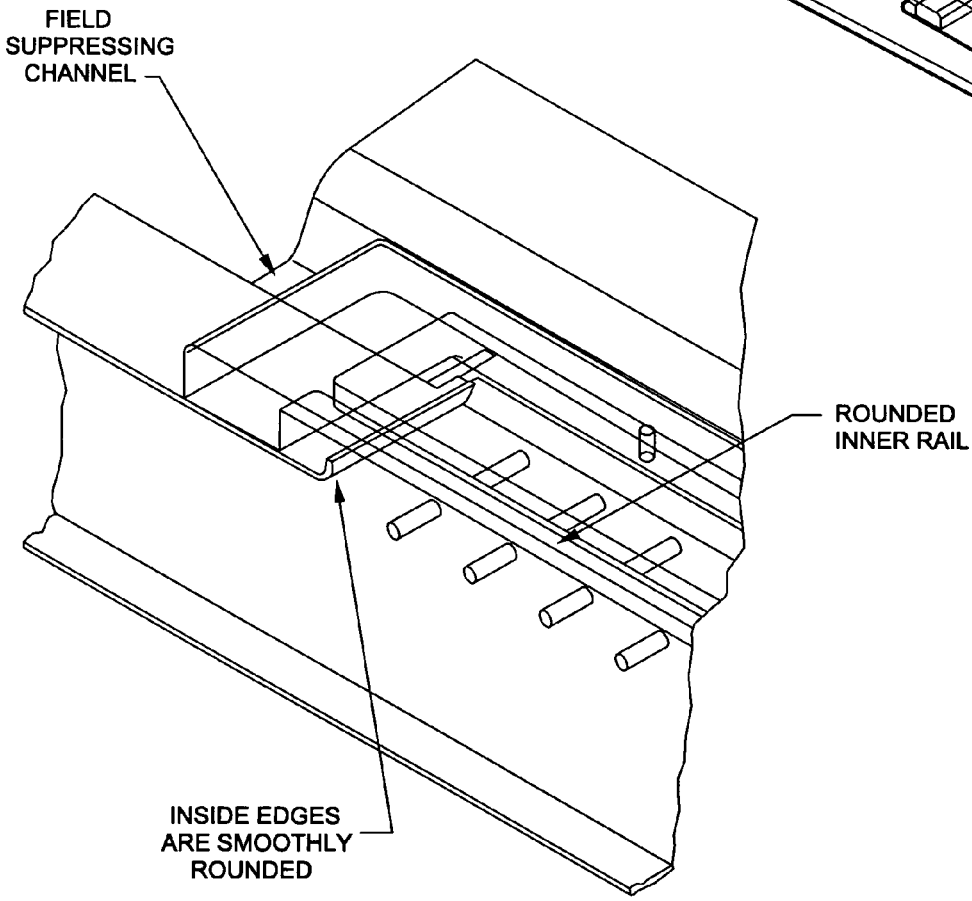
FIG. 10A shows the cutaway details of the edges and field-suppressing channels of FIG. 10.
Figure 11:
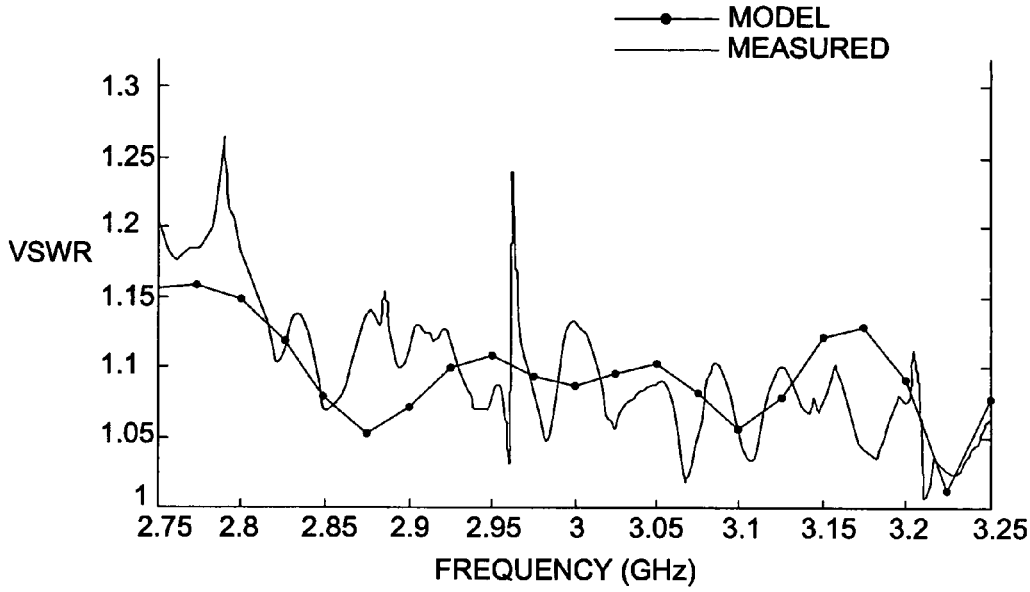
FIG. 11 shows the measured and predicted VSWR vs. frequency graph for the flat-aperture waveguide sidewall emitting antenna.
Figure 12A:
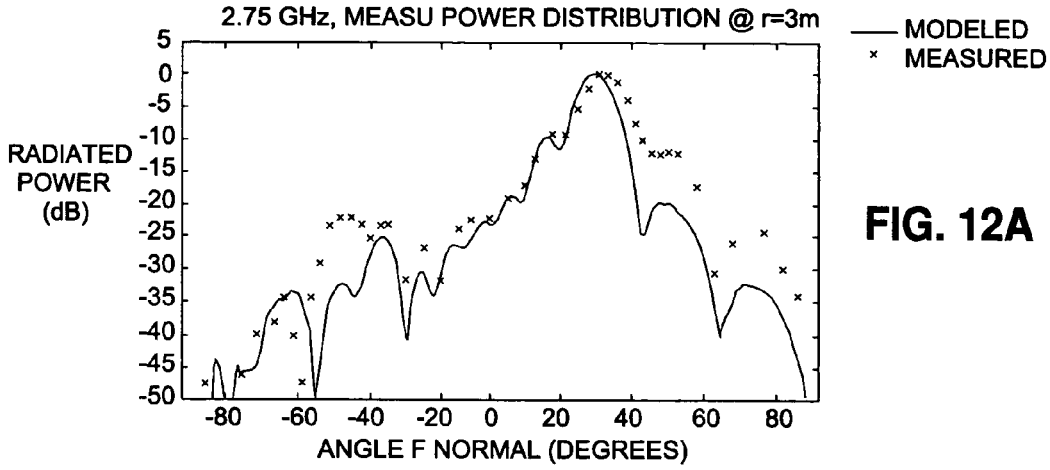
FIGS. 12A-12C provide graphs of measured vs. modeled H-plane antenna patterns for the flat-aperture waveguide sidewall emitting antenna.
Figure 12B:
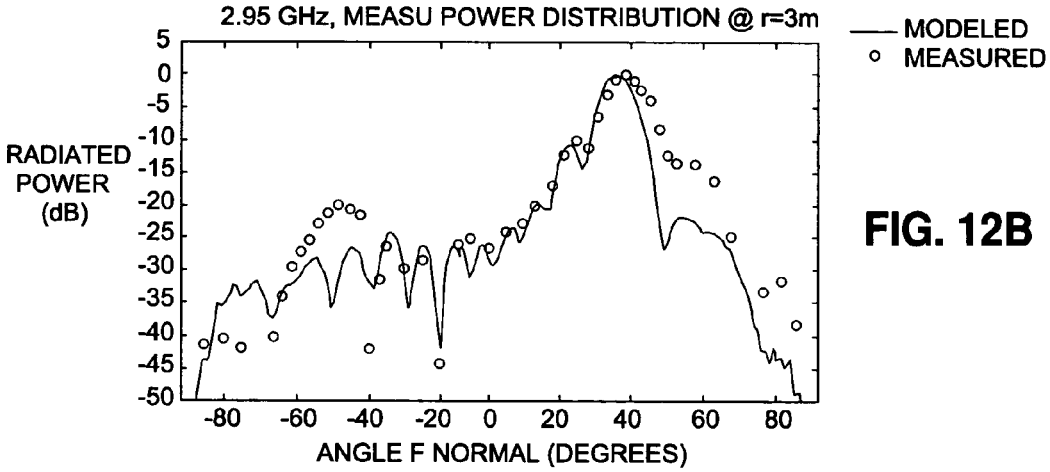
Figure 12C:
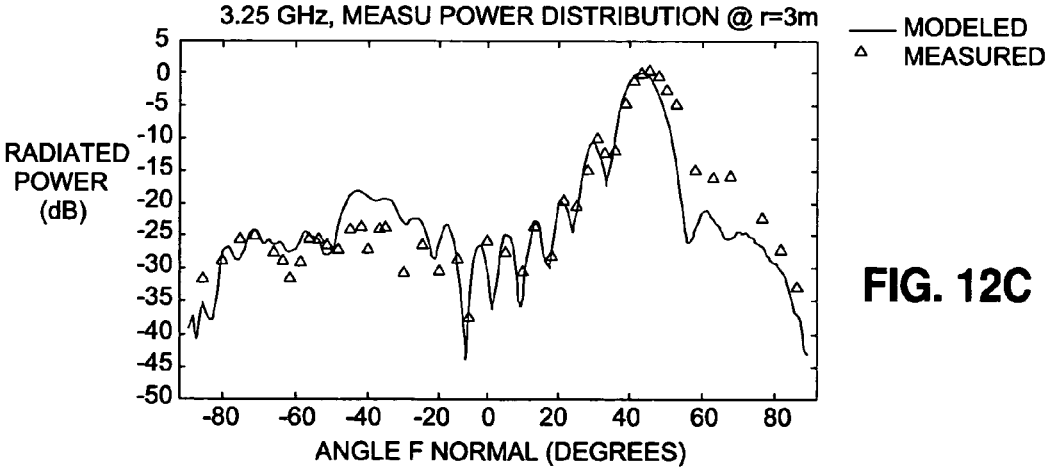

FIG. 11 shows measurements of VSWR vs. frequency made with a low-power proof-of-principle version of the antenna in FIG. 10, along with a comparison to the predictions from a numerical modeling code. This demonstrates that the FAWSEA is capable of low-reflection operation over a frequency bandwidth of at least $f_0$+/−8%, which exceeds that of most HPM sources. FIGS. 12A-12C show measured and predicted H-plane antenna patterns, confirming the predicted directional beam formation.

Figure 13:
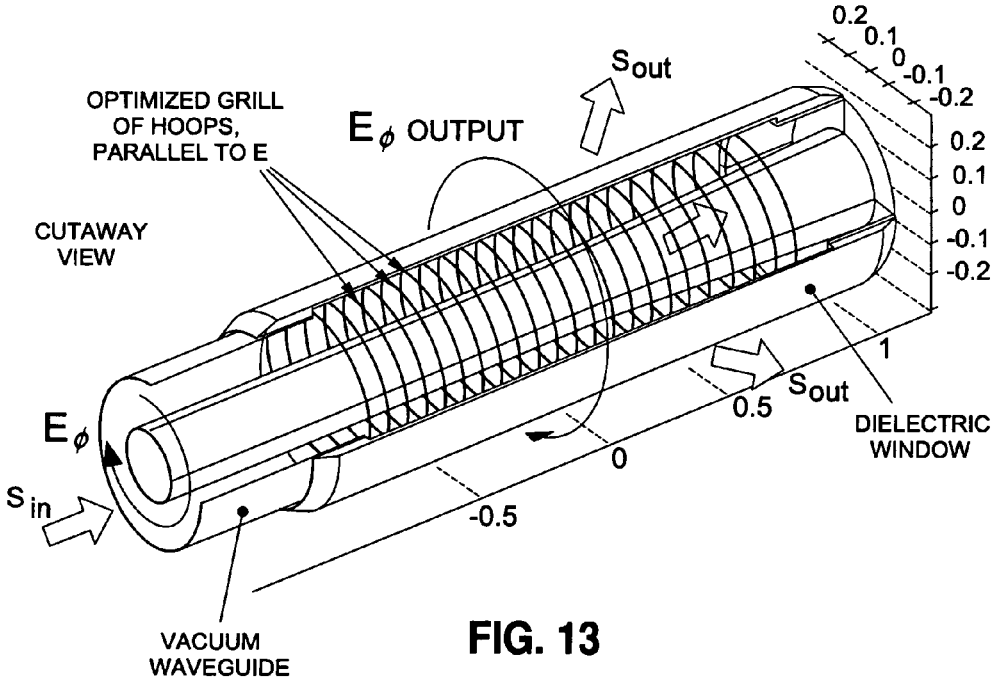
FIG. 13 illustrates a cylindrical version of flat-aperture waveguide sidewall emitting antenna.
Figure 14A:
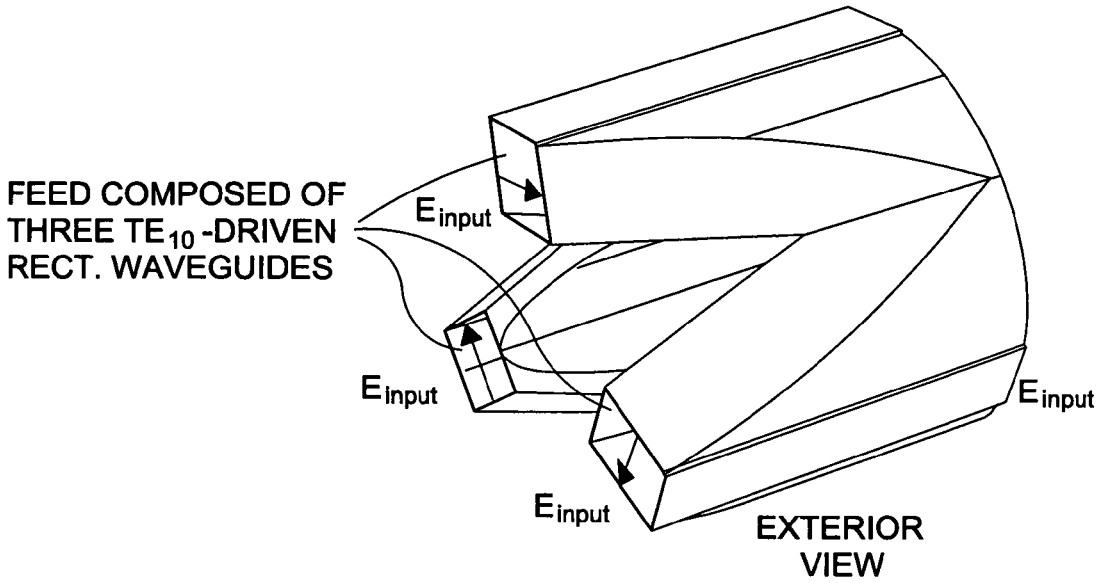
FIG. 14A shows the exterior structure of an example of an input feeding waveguide configuration to drive the cylindrical version as shown in FIG. 13.
Figure 14B:
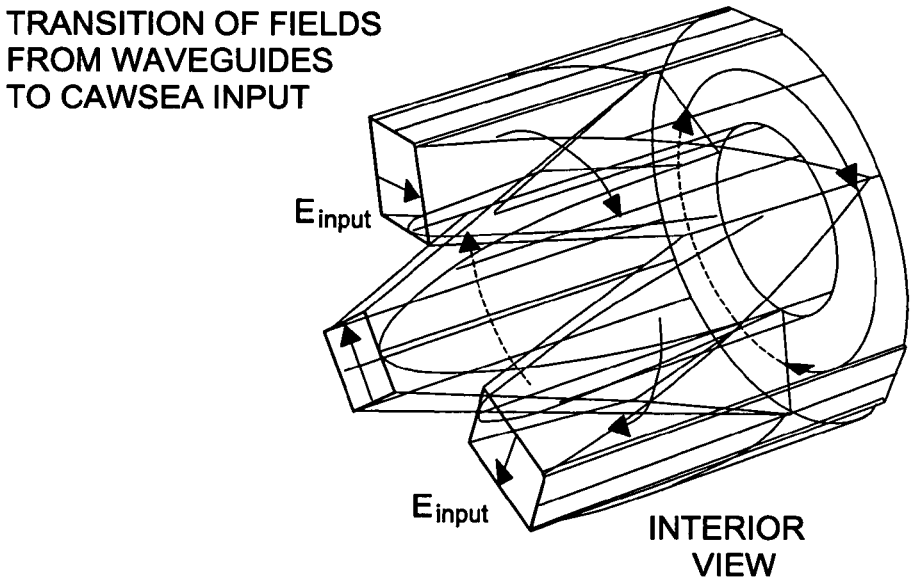
FIG. 14B shows the interior structure of an example of an input feeding waveguide configuration to drive the cylindrical version as shown in FIG. 13.

FIG. 13 shows another embodiment of the flat-aperture waveguide sidewall-emitting antenna. As shown, the operating principles of the FAWSEA can be extended beyond the particular geometric realizations discussed earlier. The reshaping of the FAWSEA makes it more suitable for use in a cylindrical HPM munition and/or missile. An appropriate name for this design variation would be a "CAWSEA," or Curved Aperture Waveguide Sidewall-Emitting Antenna. The direction of power flow (the S vector) is indicated by the red arrows. A full 360-degree azimuthally-continuous input $E_\Phi$ would be required to feed the CAWSEA of FIG. 13, but quarter-cylinder, half-cylinder, and other shaped CAWSEAs could also be developed. Feeding could be accomplished via joining multiple output arms from an HPM source (see FIGS. 14A and 14B for an example). We note that high power relativistic magnetrons are an important class of HPM sources that can be operated with multiple waveguide arm outputs, suitable for driving this type of antenna.

The above description is given by way of example, and not limitation. Given the above disclosure, one skilled in the art could devise variations that are within the scope and spirit of the invention disclosed herein, including various geometries realizations of the antenna. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A flat-aperture sidewall-emitting waveguide antenna, comprising:

a. a pair of sidewalls extending between an input and an end plate, wherein at least one of the sidewalls is tapered to provide a flared section in an E-plane;

b. a plurality of fins from the input and the end plate between the sidewalls; and c. a plurality of grill wires extending through the fins between the sidewalls.

2. The antenna of claim 1, further comprising:

a. a top frame connected to top edges of the sidewalls and the end plates; and b. a bottom plate extending between bottom edges of the sidewalls, the end plates and the input.

3. The antenna of claim 2, wherein the top frame further comprises a plurality of rounded rails placed on top of each of the fins.

4. The antenna of claim 2, further comprising an O-ring material placed on top of the top frame.

5. The antenna of claim 2, further comprising a dielectric window placed over the top frame.

6. The antenna of claim 2, wherein the top frame includes a groove formed therein for suppressing electric fields.

* * * * *